United States Patent [19]

Ostrin

[11] 4,073,529

[45] Feb. 14, 1978

[54] GOLF BALL RETRIEVER

[76] Inventor: Albert Ostrin, 441 NE. 195 St., N. Miami Beach, Fla. 33179

[21] Appl. No.: 655,895

[22] Filed: Feb. 6, 1976

[51] Int. Cl.[2] ..... A63B 47/02

[52] U.S. Cl. ..... 294/19 A

[58] Field of Search ..... 294/1 R, 19 R, 19 A, 294/99 R, 110 A, 113, 114; 43/5, 17.5; 56/328 R; 240/2 R, 2 E, 2.25; 250/462, 465; 273/32 F, 162 E, 163 R, 164

[56] References Cited

U.S. PATENT DOCUMENTS

| | | | |
|---|---|---|---|
| 2,016,078 | 10/1935 | Demyttenabere | 294/20 |
| 2,962,321 | 11/1960 | Fowler et al. | 294/19 A |
| 3,136,573 | 6/1964 | Harke | 294/19 A |
| 3,186,593 | 6/1965 | Miotke | 294/19 A X |
| 3,316,008 | 4/1967 | Baugh | 294/19 A |
| 3,957,297 | 5/1976 | Hanks | 294/19 A |

FOREIGN PATENT DOCUMENTS

| | | | |
|---|---|---|---|
| 152,771 | 6/1904 | Germany | 294/19 A |

*Primary Examiner*—Johnny D. Cherry
*Attorney, Agent, or Firm*—Malin & Haley

[57] ABSTRACT

An improved golf ball retriever for recovering an inaccessible ball from a water hazard or the like which eliminates scooping action and ball manuevering during the retrieval action. The device includes three moveable, partial biased fingers or gates disposed in a larger than ball sized cylindrical housing that permits a single vertical downward movement to entrap the ball in the cylindrical housing. The upper rim of the housing includes a luminous material which acts as a guide in murky water. The ball retaining fingers are non-linearly spring biased to allow delicate finger movement and engagement to the point of positive ball entrapment without disturbing or prematurely dislodging the ball.

1 Claim, 7 Drawing Figures

GOLF BALL RETRIEVER

BACKGROUND OF THE INVENTION

This invention relates generally to an improved golf ball retriever, and specifically to a golf ball retriever utilizing a single vertical stroke to positively entrap the ball (thereby outmoding scooping devices).

As is known to one who golfs, an errant golf shot often results in the golf ball coming to rest in a generally unaccessible area such as a water hazard, lake or stream. Many devices have been shown in the prior art to retrieve such inaccessible golf balls. A major problem encountered is that often times, the ball is unstably balanced on submerged objects offering very little ball support such that a small movement of the ball will cause it to fall to other areas where it cannot be seen or reached. It is essential in such situations that the ball be positively entrapped on the first attempt at retrieval, or it may never be retrieved. Many of the prior art devices use an under ball scooping action to retrieve. This often results in the premature disturbance of the ball because of the dynamic forces generated against the ball by the movement of the scoop around the sides or bottom of the ball positioning the scoop. In some environments, it is difficult or impossible to get the scoop edge under the ball without moving the ball.

Other types of devices use rakes or small rings which require extreme agility in manuevering the device to recover the ball without prematurely moving the ball out of position.

The instant invention overcomes the problems of the prior art by providing an improved golf ball retriever requiring a single vertical actuating stroke for positive ball entrapment. The device employs a cylindrical housing having one or more properly sized ball entrapping gates or fingers disposed radially inwardly near the open bottom edge of the housing.

Each finger has a downlock position which prevents movement of the ball through the housing from top to bottom. Each finger is biased by a spring to allow upward movement from the downlock position to allow a ball to move upwardly (from the bottom of the housing) past the fingers. The initial spring bias is slight (not detrimental to ball movement). The biasing spring force increases to a maximum at the point of ball passage to snap the finger back to the downlock position.

BRIEF DESCRIPTION OF THE INVENTION

A golf ball retrieving device for recovering a golf ball from a generally inaccessible area such as a water hazard comprising a cylindrical housing having an oversized diameter substantially larger than the diameter of a conventional golf ball, said cylindrical housing being open at its top and bottom, a telescopically adjustable elongated shaft connected at one end to the exterior surface of said housing, and one or more golf ball entrapping gates disposed within the housing which act to positively entrap the ball in the housing when the housing is moved substantially vertically downwardly into engagement with the ball. In essence, a ball can move in only one direction through the housing.

In one embodiment, three entrapment fingers or gates are radially disposed approximately 120° apart. Utilizing a 2¾ inches housing diameter, each finger is ⅝ inches long. The conventional golf ball is 1¾ inches in diameter. The enlarged housing diameter permits greater ball encirclement tolerances for the operator to compensate for error induced from light diffraction and poor visual conditions caused by murky waters. The upper rim of the housing includes a luminous material which also acts as a visual guide for positioning the housing prior to activation. The upper housing is open to give a better view of the ball and ease of the ball removal from the housing after recovery.

Each finger in one embodiment is spring biased with a coil spring in one direction and has a predetermined pivotal downward traveling limit or stop. With the finger at the downward locked limit, very little biasing force is present against the upward movement of the finger. As the finger is moved upwardly by engagement with the ball exterior surface during activation of the device, the spring bias increases gradually until the overcenter ball engaging position of finger to ball center diameter is reached. At this point, past ball center, the finger has sufficient resilience or bias to positively pivot or snap the gate beneath the ball, entrapping the ball in the cylindrical housing. Using a coil spring (in this embodiment) the spring biasing force acts in a nonlinear increasing function to provide ever increasing force on the finger or fingers, which are sized in length in conjunction with the diameter size of the housing to brush by the ball center diameter, and once over center, snaps back to the downlock position trapping the ball in the upper housing.

To operate the device, the housing cylindrical axis is aligned generally in a vertical position above the ball. A single downward vertical stroke is applied to the housing which after an initial delicate engagement of the fingers positively entraps the ball in the housing.

The instant invention is capable of operation in firm or soft ball supporting areas. It can be used to retrieve balls delicately or precariously balanced on weeds, high grass, or generally any ball retrieving situation in which a golf ball is positioned in unstable equilibrium in an unaccessible water hazard which if prematurely disturbed would result in the ball moving to an area where it cannot be seen or found.

It is an object of this invention to provide a golf ball retriever for recovering a golf ball resting in an inaccessible water hazard which eliminates the necessity of scooping or getting under the ball and thereby greatly increases the number of successful recoveries.

It is another object of this invention to provide a golf ball retriever which can successfully recover and entrap a golf ball resting in unstable equilibrium in a relatively inaccessible area.

It is yet another object of this invention to provide a golf ball retriever that does not require extreme agility of the operator for successful ball recovery and includes a luminous alignment guide and open top for proper positioning.

But still yet another object of this invention is to provide a golf ball retriever device that is not complex in construction and operation that employs a single downward vertical stroke over the ball for activation.

In accordance with these and other objects which will be apparent hereinafter, the instant invention will now be described with particular reference to the accompanying drawings.

PREFERRED EMBODIMENT OF THE INVENTION

Figure 1:
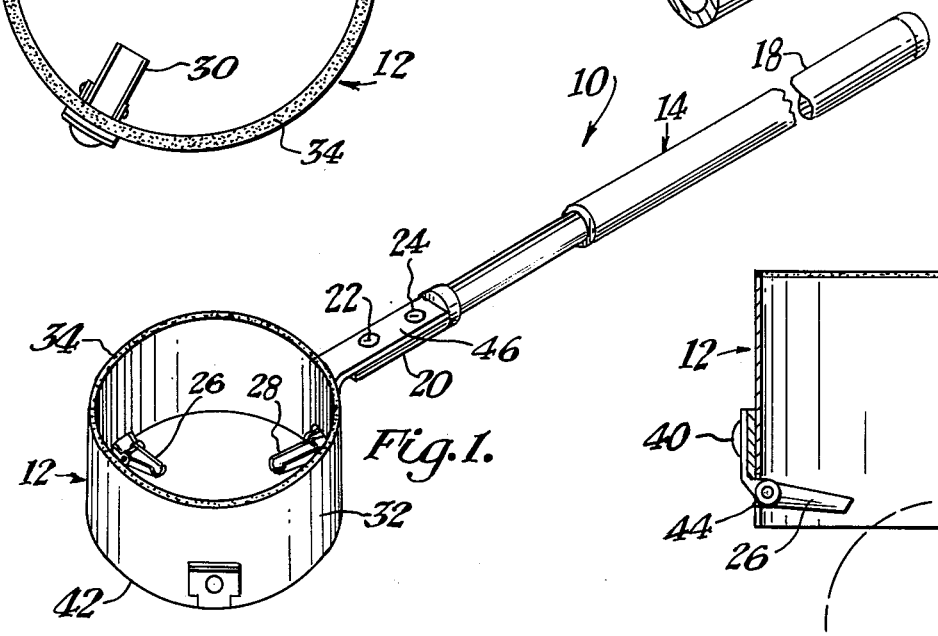
FIG. 1 shows a perspective view of one embodiment of the instant invention.

Referring now to the drawings, and specifically FIG. 1, the instant invention is shown generally at 10 comprised of a cylindrical housing 12 which is open at top and bottom. The housing 12 is connected to a telescopically adjustable handle 14 by threadable fasteners 22 and 24 and connector flange 46 mounted on an exterior portion of the housing 12. With the cylindrical longitudinal axis substantially vertical, the handle 14 forms a 45° angle with the horizontal. Disposed on the bottom rim 42 of the housing 12 are three ball engaging gates 26, 28 and 30 which are described in greater detail below. The top rim 34 of the housing is coated with a luminous paint or material which visually accentuates the housing shape and position, especially when immersed in murky or cloudy water.

The housing 12 and handle 14 may be constructed of any somewhat rigid material such as metal or plastic. The diameter of the housing 12 is selected to be at least 1.5 times larger than the diameter of a conventional golf ball, which reduces the positioning accuracy necessary when operating the device.

The handle 14 includes a smaller diameter tube 16 received into a larger diameter shaft 18 with a resilient friction lock provided to permit lockable telescopic action of the handle to effectively lock the handle at a desired length. The smaller tube 16 is grooved and keyed to the larger shaft handle to prevent relative rotation of the handle 14 and cylinder housing 12.

Figure 2:
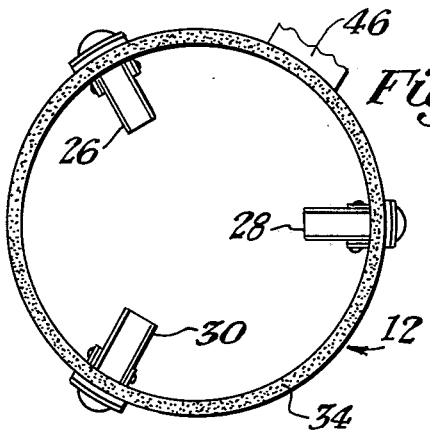
FIG. 2 shows a top plan view of the instant invention.
Figure 3:
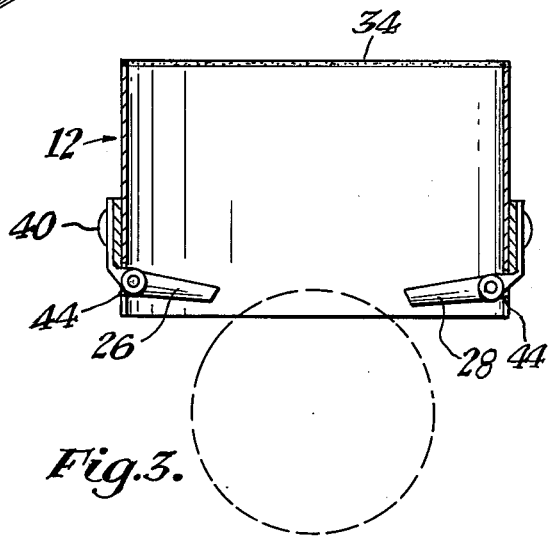
FIGS. 3, 3*a* and 3*b* show a side elevational view partially in cross-section of the various ball engaging positions during the operation of the instant invention.
Figure 3B:
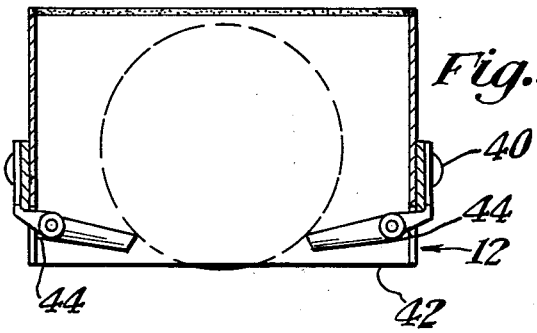
Figure 3A:
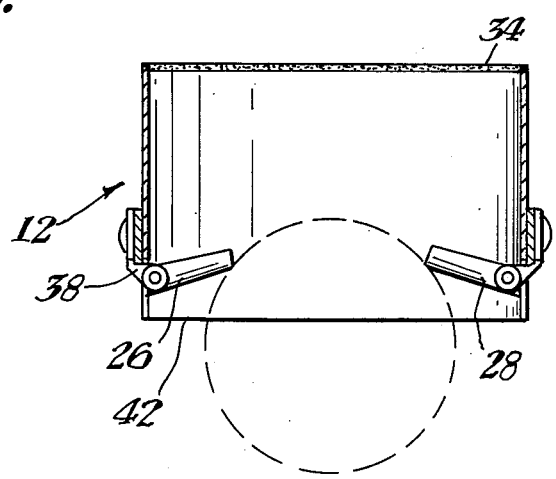

FIG. 2 shows the ball recovery housing 12 and three partially biased ball entrapped gates 26, 28 and 30 radially disposed in a substantially common plane near the bottom rim of the housing 12. The length of each finger is selected relative to the diameter of the housing to permit a portion of a conventional golf ball to be received above the fingers prior to ball-finger engagement. In this embodiment, each finger is $\frac{5}{8}$ inch long with a housing diameter of $2\frac{3}{4}$ inches. FIGS. 3, 3*a*, and 3*b* show the operation of the device to achieve entrapment of the ball in the housing. The biased entrapment gates either individually or together initially contact and brush the sides of the ball without applying any significant downward force to the ball. As the vertical downward movement continues, the gates approach the center diameter of the ball and the spring force gradually increases in the gates. The force on the gate engaging the ball surface becomes horizontal as the relative ball gate position changes. After the gate has moved relatively past the center diameter of the ball, the spring force snaps the gate beneath the ball, returning the gate to its initial downlock horizontal position.

When the fingers are in the downlock position, a conventional golf ball will not fit through the opening between the ends of the fingers 26, 28 and 30.

FIG. 3 shows the ball and housing positioned prior to engagement. FIG. 3*a* shows the initial engagement of the gates when the spring bias is minimal and does not detrimentally interfere with the ball movement relative to the housing from bottom to top. FIG. 3*b* shows the gates returned to the downlock ball retaining position which prevent downward movement of the ball to allow recovery.

Figure 4:
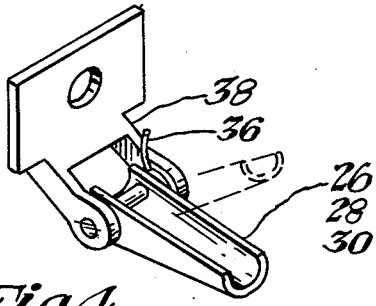
FIG. 4 shows a perspective view of one of the ball entrapping gates utilized in the instant invention.

FIG. 4 shows one gate 26 in the downlock position pivotally connected by spring 36 to bracket 38 which attaches to housing exterior 32 by a rivet 40 or other conventional fastener.

Downward pivotal movement of each gate is limited by an extended edge 44 (FIG. 3*b*) which engages the inside surface of housing 12, limiting downward pivotal movement of the gate. The spring is coiled to provide increasing spring bias force as gate 26, 28 or 30 is moved in an upward direction. Each gate is pivotal from the substantially horizontal position shown in FIG. 3*b* upward to an operating position at ball center diameter of approximately 45° to the horizontal.

Figure 5:
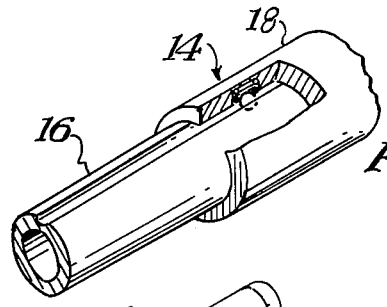
FIG. 5 shows a perspective fragmentary view of the telescopically adjustable handle.

FIG. 5 shows the locking mechanism which prevents the relative rotation of shaft 16 within shaft 18 and which allows longitudinal positions of each relative to each other to adjust the length of the handle.

The instant invention has been shown and described herein in what is considered to be the most practical and preferred embodiment. It is recognized, however, that departures may be made therefrom within the scope of the invention and that obvious modifications will occur to a person skilled in the art.

What I claim is:

1. A device for retrieving a golf ball from a water hazard to recover a golf ball even if in unstable equilibrium comprising:

an elongated handle;

a cylindrical housing having an open top and bottom connected to one end of said handle;

three spring biased ball engaging gates which allow passage of a conventional golf ball through said housing in one direction from bottom to top, each gate pivotally mounted to the bottom inside of said housing disposed radially inwardly, the spring biasing force increasing gradually from a gate downlocked position to a ball passing engagement position whereby each of said ball engaging gates are biased to return to the downlocked position after passage of said ball within said housing, a luminous material disposed on the top of said housing for optically enhancing the positioning of said housing.

* * * * *